US008407848B2

(12) United States Patent
Pung et al.

(10) Patent No.: US 8,407,848 B2
(45) Date of Patent: Apr. 2, 2013

(54) CLEANING PAD AND CLEANING IMPLEMENT

(75) Inventors: David John Pung, Loveland, OH (US); Hugh Joseph O'Donnell, Cincinnati, OH (US); Edward Phillip Allie, West Chester, OH (US); Vincent Sean Breidenbach, Middletown, OH (US); Jeffrey Len Osborne, Harrison, OH (US); Nicola John Policicchio, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 13/548,631

(22) Filed: Jul. 13, 2012

(65) Prior Publication Data

US 2012/0279005 A1 Nov. 8, 2012

Related U.S. Application Data

(63) Continuation of application No. 10/958,852, filed on Oct. 5, 2004, now Pat. No. 8,250,700.

(60) Provisional application No. 60/509,560, filed on Oct. 8, 2003.

(51) Int. Cl.
*A47L 13/20* (2006.01)

(52) U.S. Cl. ..... 15/228; 15/231; 15/104.94

(58) Field of Classification Search ..... 15/231, 15/228, 104.94, 244.1, 208, 209.1
See application file for complete search history.

(56) References Cited

U.S. PATENT DOCUMENTS

| | | | | |
|---|---|---|---|---|
| 3,656,202 | A | 4/1972 | Paton | |
| 4,324,016 | A | 4/1982 | Herbig | |
| 4,864,675 | A | 9/1989 | Jones | |
| 5,488,750 | A | 2/1996 | Vosbikian et al. | |
| 5,881,423 | A | 3/1999 | Shumway et al. | |
| 6,101,661 | A | 8/2000 | Policicchio et al. | |
| 6,132,841 | A | 10/2000 | Guthrie et al. | |
| 6,507,972 | B2 | 1/2003 | Hart | |
| 6,842,936 | B2 | 1/2005 | Policicchio et al. | |
| 2003/0044569 | A1 * | 3/2003 | Kacher et al. | 428/100 |
| 2003/0126710 | A1 * | 7/2003 | Policicchio et al. | 15/228 |
| 2004/0016074 | A1 * | 1/2004 | Tanaka | 15/228 |
| 2004/0111817 | A1 | 6/2004 | Chen et al. | |
| 2005/0022843 | A1 | 2/2005 | Policicchio et al. | |
| 2005/0081888 | A1 | 4/2005 | Pung et al. | |

FOREIGN PATENT DOCUMENTS

| | | | |
|---|---|---|---|
| EP | 1212972 | A2 | 6/2002 |
| WO | WO 02/090483 | A2 | 11/2002 |

OTHER PUBLICATIONS

U.S. Appl. No. 10/958,852 Examiners Decision on Appeal Dated May 23, 2012.

* cited by examiner

*Primary Examiner* — Shay Karls
(74) *Attorney, Agent, or Firm* — Larry L. Huston; Steven W. Miller

(57) ABSTRACT

The present invention relates to a cleaning implement comprises a handle; a head portion pivotally attached to the handle comprising an upper surface and a lower surface connected to the upper surface by side edges; and a cleaning pad removably attached to the head portion, the cleaning pad comprising an absorbent layer which extends over the lower surface of the head portion and a scrubbing strip which extends along a side edge of the head portion.

21 Claims, 4 Drawing Sheets

CLEANING PAD AND CLEANING IMPLEMENT

CROSS REFERENCE TO RELATED APPLICATION

This application is a continuation of and claims priority under 35 U.S.C. §120 to U.S. patent application Ser. No. 10/958,852, filed Oct. 5, 2004 now U.S. Pat. No. 8,250,700, which in turn claims priority under 35 U.S.C. §119(e) to U.S. Provisional Application No. 60/509,560, filed on Oct. 8, 2003.

FIELD OF THE INVENTION

The present invention relates to cleaning pads and cleaning implements for cleaning hard surfaces, and in particular floors. More particularly, the present invention relates to the cleaning of tough stains which tend to be random occurrences but which require aggressive cleaning to remove them.

BACKGROUND OF THE INVENTION

Numerous implements are known for cleaning hard surfaces such as tiled floors, linoleum floors, hardwood floors, counter tops, and the like. In the context of cleaning floors, suitable implements typically comprise a handle and means for applying a liquid cleaning composition to the floor. Some implements are reusable, including mops containing cotton strings, cellulose and/or synthetic strips, sponges, and the like. While these mops are successful in removing many soils from hard surfaces, they typically require the inconvenience of performing one or more rinsing steps during use to avoid saturation of the mop with dirt, soil, and other residues. This requires the use of a separate container to perform the rinsing step(s), and typically these rinsing steps fail to sufficiently remove dirt residues. This can result in redeposition of significant amounts of soil during subsequent passes of the mop. Furthermore, as reusable mops are used over time, they become increasingly soiled and malodorous. This negatively impacts subsequent cleaning performance.

To alleviate some of the negative attributes associated with reusable cleaning implements, mops having disposable cleaning pads have been provided. For example, WO-A-0027271 describes a cleaning device comprising a handle and a head portion pivotally attached thereto, and a removable cleaning pad for attachment to the head portion, the cleaning pad comprising at least one absorbent layer and various other optional features, including a liquid pervious scrubbing layer to aid in the removal of tough stains. The scrubbing layer is a monolayer or multilayer structure, which may contain openings to facilitate scrubbing of the surface to be cleaned, and uptake of particulate matter removed from the surface. The cleaning pad may also comprise an abrasive scrubbing strip, typically located in the centre of the lower surface of the cleaning pad, i.e. that surface which contacts the surface to be cleaned during normal cleaning operation. A separate scrubbing strip may be attached to the leading edge of the head portion of the cleaning implement, which may be brought into contact with the surface to be cleaned by tilting the head portion, and turning this through 90°. A key challenge in tough stain cleaning is the fact that tough stains are random occurrences in the home, and yet require abrasive cleaning to remove them. Examples of common tough stains include dried particulate foods, pasta, tomato sauces, and scuff marks. While it is desirable to have means to remove tough stains when they occur, it is undesirable to employ those means across the entirety of the surface to be cleaned, for fear of damaging that surface. This is certainly a problem with the cleaning implement disclosed in WO-A-0027271, where the scrubbing strip is located on the lower surface of the cleaning pad, and preferably in the centre of the lower surface of the cleaning pad.

WO-A-02090483 describes an impregnated wipe, i.e. one that has been pre-moistened with a liquid cleaning composition, suitable for cleaning hard surfaces. The wipe comprises an absorbent substrate having on one side a textured abrasive surface formed from nodules and/or striations of abrasive material having a hardness ranging from 40 to 100 Shore D units. As the abrasive material extends over the entirety of the surface of the wipe, use of the wipe may damage the surface to be cleaned in areas not suffering from the presence of tough stains.

At present, the only alternative to avoid damage to the surface to be cleaned is to interrupt the cleaning process and attempt to remove a tough stain through the use of an additional cleaning implement, for instance a brush, cloth or towel. When cleaning a floor, this requires bending and hard manual work to remove the tough stain.

Furthermore, a problem associated with the location of a scrubbing strip on the head portion of the cleaning implement itself is that particulate material removed as a result of scrubbing remains on the cleaning implement. This not only reduces effectiveness of the cleaning implement over time, but may also result in redeposition of formerly removed particulate matter, rendering the whole cleaning process inefficient.

SUMMARY OF THE INVENTION

According to a first aspect of the present invention, a cleaning implement comprises a handle; a head portion pivotally attached to the handle comprising an upper surface and a lower surface connected to the upper surface by side edges; and a cleaning pad removably attached to the head portion, the cleaning pad comprising an absorbent layer which extends over the lower surface of the head portion and a scrubbing strip which extends along a side edge of the head portion.

According to a second aspect of the present invention, a cleaning kit comprises a cleaning implement comprising a handle and a head portion pivotally attached thereto; and a cleaning pad of the type described above.

According to a third aspect of the present invention, a method of cleaning a hard surface comprises providing a cleaning implement comprising a handle and a head portion pivotally attached thereto, the head portion having an upper surface and a lower surface connected to the upper surface by side edges; attaching to the head portion a cleaning pad of the type described above, such that the absorbent layer extends over the lower surface of the head portion and the scrubbing strip extends along a side edge of the head portion; optionally applying a liquid cleaning composition to the surface to be cleaned and/or to the head portion of the cleaning implement; wiping the hard surface with the cleaning implement; and, optionally, removing the cleaning pad from the head portion of the cleaning implement.

According to a fourth embodiment of the claimed invention, a disposable cleaning pad comprises a longitudinally-extending central panel comprising an absorbent layer, and a side panel abutting at least each longitudinally-extending side of the central panel, wherein at least one of the side panels comprises a scrubbing strip, and wherein the central panel is more highly absorbent than the side panels. Typically, the central panel comprises at least one third of the width of the cleaning pad.

As is apparent from the above, the cleaning pad for use in the present invention includes a scrubbing strip which, when the cleaning pad is attached to a cleaning implement, does not make contact with the surface to be cleaned during the normal cleaning operation, thereby avoiding damage to the surface to be cleaned. However, when it is desired to remove a tough or stubborn stain the cleaning implement may be manipulated, for instance by tilting the head portion of the implement, in order to bring the scrubbing strip into contact with the surface to be cleaned, and a repeated scrubbing action can be used to remove the tough stain of interest. Once removed from the surface, the tough stain material may be disposed of with the cleaning pad, rather than remaining on the cleaning implement, thereby avoiding the risk of strain redeposition on further use of the cleaning implement.

Preferably cleaning pads of this type will be pre-moistened, or impregnated, with a liquid cleaning composition.

DEFINITIONS

As used herein, the term "x-y dimension" refers to the plane orthogonal to the thickness of the cleaning pad, or a component thereof. The x and y dimensions correspond to the length and width, respectively, of the cleaning pad or a pad component. In this context, the length of the pad is the longest dimension of the pad, and the width the shortest. In general, in use, a cleaning implement will be moved in a direction parallel to the y-dimension (or width) of the pad. Of course, the present invention is not limited to the use of cleaning pads having four sides. Other shapes, such as circular, elliptical, and the like, can also be used. When determining the width of the pad at any point in the z-dimension, it is understood that the pad is assessed according to its intended use.

As used herein, the term "z-dimension" refers to the dimension orthogonal to the length and width of the cleaning pad of the present invention, or a component thereof. The z-dimension therefore corresponds to the thickness of the cleaning pad or a pad component.

As used herein, an "upper" layer of a cleaning pad is a layer that is relatively further away from the surface that is to be cleaned (i.e., in the implement context, relatively closer to the implement handle during use). The term "lower" layer conversely means a layer of a cleaning pad that is relatively closer to the surface that is to be cleaned (i.e., in the implement context, relatively further away from the implement handle during use).

As used herein, the "leading" or "front" edge of a cleaning pad is that edge which on a forwards wiping motion crosses the surface to be cleaned in advance of the opposing "trailing" or "rear" edge of the cleaning pad.

DETAILED DESCRIPTION OF THE INVENTION

The cleaning pad for use in the present invention comprises an absorbent layer which serves to retain any fluid and soil absorbed by the cleaning pad during use. The absorbent layer may comprise a single layer or a plurality of layers. Preferably the absorbent layer comprises a plurality of layers which are designed to provide the cleaning pad with multiple planar surfaces and/or density gradients, as is described in more detail below.

The absorbent layer comprises any material capable or absorbing and retaining fluid during use. Typically, the absorbent layer comprises fibrous material, preferably nonwoven fibrous material. Fibers useful in the present invention include those that are naturally occurring (modified or unmodified), as well as synthetically made fibers. Examples of suitable unmodified/modified naturally occurring fibers include cotton, Esparto grass, bagasse, kemp, flax, silk, wool, wood pulp, chemically modified wood pulp, jute, ethyl cellulose, and cellulose acetate. Suitable synthetic fibers can be made from polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like. The absorbent layer can comprise solely naturally occurring fibers, solely synthetic fibers, or any compatible combination of naturally occurring and synthetic fibers.

The fibers useful herein can be hydrophilic, hydrophobic or can be a combination of both hydrophilic and hydrophobic fibers. As used herein, the term "hydrophilic" is used to refer to surfaces that are wettable by aqueous fluids deposited thereon. Hydrophilicity and wettability are typically defined in terms of contact angle and the surface tension of the fluids and solid surfaces involved. This is discussed in detail in the American Chemical Society publication entitled "Contact Angle, Wettability and Adhesion", edited by Robert F. Gould (Copyright 1964). A surface is said to be wetted by a fluid (i.e., hydrophilic) when either the contact angle between the fluid and the surface is less than 90°, or when the fluid tends to spread spontaneously across the surface, both conditions normally co-existing. Conversely, a surface is considered to be "hydrophobic" if the contact angle is greater than 90° and the fluid does not spread spontaneously across the surface.

The particular selection of hydrophilic or hydrophobic fibers will depend upon the other materials included in the cleaning pad, for instance in different absorbent layers. That is, the nature of the fibers will be such that the cleaning pad exhibits the necessary fluid delay and overall fluid absorbency. Suitable hydrophilic fibers for use in the present invention include cellulosic fibers, modified cellulosic fibers, rayon, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene or polypropylene, polyacrylics, polyamides, polystyrenes, polyurethanes and the like.

Suitable wood pulp fibers can be obtained from well-known chemical processes such as the Kraft and sulfite processes. It is especially preferred to derive these wood pulp fibers from southern soft woods due to their premium absorbency characteristics. These wood pulp fibers can also be obtained from mechanical processes, such as ground wood, refiner mechanical, thermomechanical, chemimechanical, and chemi-thermomechanical pulp processes. Recycled or secondary wood pulp fibers, as well as bleached and unbleached wood pulp fibers, can be used.

Another type of hydrophilic fiber for use in the present invention is chemically stiffened cellulosic fibers. As used herein, the term "chemically stiffened cellulosic fibers" means cellulosic fibers that have been stiffened by chemical means to increase the stiffness of the fibers under both dry and aqueous conditions. Such means can include the addition of a chemical stiffening agent that, for example, coats and/or impregnates the fibers. Such means can also include the stiffening of the fibers by altering the chemical structure, e.g., by crosslinking polymer chains.

Where fibers are used as the absorbent layer (or a constituent component thereof), the fibers can optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or web of fibers together in each of the respective layers. This can be beneficial in providing additional overall integrity to the cleaning pad.

Amongst its various effects, bonding at the fiber intersections increases the overall compressive modulus and strength of the resulting thermally bonded member. In the case of the chemically stiffened cellulosic fibers, the melting and migration of the thermoplastic material also has the effect of increasing the average pore size of the resultant web, while maintaining the density and basis weight of the web as originally formed. This can improve the fluid acquisition properties of the thermally bonded web upon initial exposure to fluid, due to improved fluid permeability, and upon subsequent exposure, due to the combined ability of the stiffened fibers to retain their stiffness upon wetting and the ability of the thermoplastic material to remain bonded at the fiber intersections upon wetting and upon wet compression. In net, thermally bonded webs of stiffened fibers retain their original overall volume, but with the volumetric regions previously occupied by the thermoplastic material becoming open to thus increase the average inter fiber capillary pore size.

Thermoplastic materials useful in the present invention can be in any of a variety of forms including particulates, fibers, or combinations of particulates and fibers. Thermoplastic fibers are a particularly preferred form because of their ability to form numerous interfiber bond sites. Suitable thermoplastic materials can be made from any thermoplastic polymer that can be melted at temperatures that will not extensively damage the fibers that comprise the primary web or matrix of each layer. Preferably, the melting point of this thermoplastic material will be less than about 90° C., and preferably between about 75° C. and about 175° C. In any event, the melting point of this thermoplastic material should be no lower than the temperature at which the thermally bonded absorbent structures, when used in the cleaning pads, are likely to be stored. The melting point of the thermoplastic material is typically no lower than about 50° C.

The thermoplastic materials, and in particular the thermoplastic fibers, can be made from a variety of thermoplastic polymers, including polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and copolymers of any of the foregoing such as vinyl chloride/vinyl acetate, and the like. Depending upon the desired characteristics, suitable thermoplastic materials include hydrophobic fibers that have been made hydrophilic, such as surfactant-treated or silica-treated thermoplastic fibers derived from, for example, polyolefins such as polyethylene or polypropylene, polyacrylics, polyamides, polystyrenes, polyurethanes and the like. The surface of the hydrophobic thermoplastic fiber can be rendered hydrophilic by treatment with a surfactant, such as a nonionic or anionic surfactant, e.g., by spraying the fiber with a surfactant, by dipping the fiber into a surfactant or by including the surfactant as part of the polymer melt in producing the thermoplastic fiber. Upon melting and resolidification, the surfactant will tend to remain at the surfaces of the thermoplastic fiber. Suitable surfactants include nonionic surfactants such as Brij® 76 manufactured by ICI Americas, Inc. of Wilmington, Del., and various surfactants sold under the Pegosperse® trademark by Glyco Chemical, Inc. of Greenwich, Conn. Besides nonionic surfactants, anionic surfactants can also be used. These surfactants can be applied to the thermoplastic fibers at levels of, for example, from about 0.2 to about 1 g. per sq. of centimeter of thermoplastic fiber.

Suitable thermoplastic fibers can be made from a single polymer (monocomponent fibers), or can be made from more than one polymer (e.g., bicomponent fibers). As used herein, "bicomponent fibers" refers to thermoplastic fibers that comprise a core fiber made from one polymer that is encased within a thermoplastic sheath made from a different polymer. The polymer comprising the sheath often melts at a different, typically lower, temperature than the polymer comprising the core. As a result, these bicomponent fibers provide thermal bonding due to melting of the sheath polymer, while retaining the desirable strength characteristics of the core polymer.

Suitable bicomponent fibers for use in the present invention can include sheath/core fibers having the following polymer combinations: polyethylene/poly-propylene, polyethylvinyl acetate/polypropylene, poly-ethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danaklon a/s and Chisso Corp.). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers can be desirable in providing more compressive strength at lower fiber thicknesses. Preferred bicomponent fibers comprise a copolyolefin bicomponent fiber comprising less than about 81% polyethylene terephthalate core and a less than about 51% copolyolefin sheath. Such a preferred bicomponent fiber is commercially available from the Hoechst Celanese Corporation, in New Jersey, under the trade name CELBOND® T-255. The amount of bicomponent fibers will preferably vary according to the density of the material in which it is used.

Methods for preparing thermally bonded fibrous materials are described in U.S. Pat. No. 5,607,414 (Richards et al), issued Mar. 4, 1997; and U.S. Pat. No. 5,549,589 (Homey et al) issued Aug. 27, 1996 (see especially columns 9 to 10). Such foams and methods for their preparation are described in U.S. Pat. No. 5,550,167 (DesMarais), issued Aug. 27, 1996; and U.S. Pat. No. 5,563,179 (Desmarais et al.), issued Oct. 8, 1996.

It may be desirable to include in the absorbent layer a material having a relatively high capacity (in terms of grams of fluid per gram of absorbent material). As used herein, the term "superabsorbent material" means any absorbent material having a g/g capacity for water of at least about 15 g/g, when measured under a confining pressure of 0.3 psi. Because a majority of the cleaning fluids useful with the present invention are aqueous based, it is preferred that the superabsorbent materials have a relatively high g/g capacity for water or water-based fluids.

Superabsorbent gelling polymers useful in the present invention include a variety of water-insoluble, but water-swellable (gelling) polymers capable of absorbing large quantities of fluids. These materials demonstrate very high absorbent capacities for water Such polymeric materials are also commonly referred to as "hydrocolloids", and can include polysaccharides such as carboxymethyl starch, carboxymethyl cellulose, and hydroxypropyl cellulose; nonionic types such as polyvinyl alcohol and polyvinyl ethers; cationic types such as polyvinyl pyridine, polyvinyl morpholinione, and N,N-dimethylaminoethyl or N,N-diethylaminopropyl acrylates and methacrylates, and the respective quaternary salts thereof. Well-known materials and are described in greater detail, for example, in U.S. Pat. No. 4,076,663 (Masuda et al), issued Feb. 28, 1978, and in U.S. Pat. No. 4,062,817 (Westerman), issued Dec. 13, 1977.

Preferred superabsorbent gelling polymers contain carboxy groups. These polymers include hydrolyzed starch-acrylonitrile graft copolymers, partially neutralized hydrolyzed starch-acrylonitrile graft copolymers, starch-acrylic acid graft copolymers, partially neutralized starch-acrylic acid graft copolymers, saponified vinyl acetate-acrylic ester copolymers, hydrolyzed acrylonitrile or acrylamide copolymers, slightly network crosslinked polymers of any of the foregoing copolymers, partially neutralized polyacrylic acid, and slightly network crosslinked polymers of partially neutralized polyacrylic acid. These polymers can be used either solely or in the form of a mixture of two or more different polymers. Examples of these polymer materials are disclosed in U.S. Pat. No. 3,661,875, U.S. Pat. No. 4,076,663, U.S. Pat. No. 4,093,776, U.S. Pat. No. 4,666,983, and U.S. Pat. No. 4,734,478.

Most preferred polymer materials for use in making the superabsorbent gelling polymers are slightly network crosslinked polymers of partially neutralized polyacrylic acids and starch derivatives thereof. Most preferably, the hydrogel-forming absorbent polymers comprise from about 50 to about 95%, preferably about 75%, neutralized, slightly network crosslinked, polyacrylic acid (i.e. poly (sodium acrylate/acrylic acid)). Network crosslinking renders the polymer substantially water-insoluble and, in part, determines the absorptive capacity and extractable polymer content characteristics of the superabsorbent gelling polymers. Processes for network crosslinking these polymers and typical network crosslinking agents are described in greater detail in U.S. Pat. No. 4,076,663.

Where superabsorbent material is included in the absorbent layer, the absorbent layer will preferably comprise at least about 15%, by weight of the absorbent layer, more preferably at least about 20%, still more preferably at least about 25%, of the superabsorbent material.

The scrubbing strip which, in use, is positioned along a side edge of the head portion of the cleaning implement, may take a variety of forms. For instance, the scrubbing strip may be a continuous or discontinuous strip of material, optionally in the form of a pattern.

The scrubbing strip necessarily comprises an abrasive material, to remove tough stains. Suitable materials include those often used for making scouring pads, typically polymers or polymer blends with or without specific abrasives. Examples of suitable polymers include thermoplastic polymers such as polypropylene, high density polyethylene, polyesters (eg., polyethylene terephthalate), nylon, polystyrene, polycarbonate, and blends and copolymers thereof.

An alternative to using materials found in typical scouring pads is to use brushes containing bristles to achieve scrubbing. Such bristles are typically composed of polymer or polymer blends, with or without abrasives. In the context of brushes, bristles made of nylon again are preferred because of rigidity, stiffness, and/or durability. A preferred nylon bristle is that commercially available from 3M Corp. under the trade name Tynex® 612 nylon. These bristles have shown less water absorption versus commercial Nylon 66. Reducing the ability of the present adhesive scrubbing strips to absorb water is important since water absorption decreases bristle stiffness and recovery while impacting scrubbing ability.

Another approach is to use netting or scrim materials to form the scrubbing strip. Again, the netting or scrim is typically composed of a polymer or polymer blend, either with or without abrasives. The netting or scrim is typically wrapped around a secondary structure to provide some bulk. The shape of the holes in the netting can include, but is not limited to, a variety of shapes such as squares, rectangles, diamonds, hexagons or mixtures thereof. Typically, the smaller the area composed by the holes in the netting the greater the scrubbing ability. This is primarily due to the fact that there are more points where the scrim material intersects, as it is these intersection points that will contact the floor. An alternative to wrapping netting or scrim is to apply molten extruded polymers directly onto a secondary structure such as a non-woven. Upon solidifying the polymer would create high point stiffer material as compared to the secondary non-woven, and thereby provides scrubbing ability.

Yet another alternative is for the scrubbing strip to comprise abrasive or coarse particulate material. A suitable particulate material comprises coarse inks available from Polytex® or coarse polymers from Vinamul, like Acrylic ABX-30.

The scrubbing strip may be a monolayer or multilayer structure. Preferred scrubbing layers take the form of film materials, provided that they have the necessary flexural rigidity to withstand repeated scrubbing actions. Suitable film materials generally have a thickness of at least 2 mils and a flexural rigidity of at least 0.10 g $cm^2$/cm, measured using the Kawabata Bending Tester Model KES-FB, from Kato Tech Co., Ltd.

The typical basis weight for flexural stiff materials suitable for use as the scrubbing strip range from 20 to 150 gsm, for instance 30 to 125 gsm. However, it is the combination of modulus and thickness that determines flexural rigidity. From a theoretical viewpoint for a rectangular homogeneous isotropic plate or film, the flexural rigidity is calculated from the formula:

$$\frac{Ebh^3}{12}$$

where E is modulus, b is plate width, and h is plate thickness. This formula indicates the importance of web thickness.

For webs composed of fibers, the relationship is more complex and both the web stiffness and fiber stiffness can be important factors. The flexural rigidity for a single fiber may be calculated from the formula:

$$\frac{\pi E d^3}{32}$$

where d is the fiber diameter.

As indicated in the above formula, the fiber diameter is significant in selecting webs that can be used as the scrubbing strip. Generally, fibers with diameters between 20 and 75 microns are useful. High modulus or tenacity fibers are also an important factor.

Preferred film materials are pervious to liquids, and in particular liquids containing soils, and yet are non-absorbent and have a reduced tendency to allow liquids to pass back through their structure and rewet the surface being cleaned. Thus, the surface of the film tends to remain dry during the cleaning operation, thereby reducing filming and streaking of the surface being cleaned and permitting the surface to be wiped substantially dry.

Preferably the film material comprises a plurality of protrusions extending outwardly from the film surface and away from the body of the cleaning pad. Alternatively, or additionally, the film may comprise a plurality of apertures.

The protrusions and/or apertures formed in the above-described film materials may be of a variety of shapes and/or sizes. For instance, the protrusions may take the form of flaps that extend outwardly from the plane of the film material at an angle thereto. The protrusions may also take the form of teeth that are rectangular, square or triangular in cross-section, or they may comprise domes or conical or frustoconical structures. Optionally, the protrusions may also comprise apertures themselves. The apertures may, for instance, be square, rectangular, triangular, circular, oval and/or hexagonal in shape, or they may take the form of narrow slits. Another option is for the apertures to be tapered or funnel-shaped, such that, preferably, the diameter at the end of the aperture closest the floor in use is greater than the diameter at the opposite end of the aperture, such that the aperture exhibits a suctioning effect as the cleaning pad is moved across the surface being cleaned. In addition, tapered or funnel-shaped apertures prevent liquid passing back from the scrubbing strip to the surface being cleaned.

The protrusions and/or apertures may be arranged in a pattern within the scrubbing strip. If so, the protrusions and/or apertures are preferably staggered relative to adjacent protrusions and/or apertures in order to enhance stain removing ability.

Specific examples of films that may be used as the scrubbing strip now follow:

1) Flexurally rigid film (as defined by the Kawabata Bending Tester mentioned above) having out-of-plane protrusions which may take the form of a rectangular or other shaped tooth capable of abrading hard surfaces without substantial loss of shape. The teeth have walls having at least two opposing faces.

2) Flexurally rigid film (as defined by the Kawabata Bending Tester mentioned above) having a slit structure comprising an overlapping set of cut flaps, with at least one flap that is raised out of the plane of the film, and that are capable of adbrading a hard surface without substantial loss of shape. Both of these types of film are created by passing a thermoplastic film or nonwoven web between counter-rotating rollers comprising intermeshing small discontinuous quasi-rectangular teeth on one roller and continuous teeth on the other roller. The size of the resulting protrusions is similar to the width of the discontinuous teeth. Typically, the protrusions range from 1 to 3 mm in the machine direction and 0.5 to 3 mm in the cross-machine direction. The height of the protrusions may be up to 5 mm.

3) A tufted flexurally rigid nonwoven film where sections of fibres are raised substantially perpendicular to the plane of the film. Typical basis weights lie in the range 20 to 100 g/m$^2$, and the fiber diameter is typically greater than 20 μm. Preferred fibers include high tenacity fibers such as PET, nylon and polypropylene. The tufted fibers may be either substantially continuous fibers or substantially broken fibers.

4) A film comprising multi-sided raised structures resembling domes, and which have sufficient structural rigidity to withstand the typical forces exerted during cleaning without permanent deformation. Typically, the dome dimensions are in the range 2 to 10 mm in the cross-machine direction and 2 to 10 mm in the machine direction. These domes are created by passing a thermoplastic film or nonwoven web between counter-rotating rollers comprising intermeshing small discontinuous quasi-rectangular teeth on one roller and intermeshing larger and patterned discontinuous quasi-retangular teeth on the other roller. The discontinuous teeth on the later roller are made in a pattern such as groups of diamonds. Reference is made in this regard to U.S. Pat. No. 5,518,801 and U.S. Pat. No. 5,968,029. Typically, the protrusions range from 1 to 10 mm in the machine direction, and 1 to 10 mm in the cross-machine direction. The domes typically are apertured by the penetration of the film. The resulting structure is a dome with apertures on one side and a pocket containing one or more tee-pee struts on the other side. This process may be used for both films and nonwovens.

5) Films having apertures which may have a variety of shapes and which may be combined with protrusions, for instance, the apertures may take the form of squares, rectangles, slits, circles, ovals or any other shape. The size of the apertures may vary widely but is typically in the range 0.5 to 10 mm$^2$, for instance 0.5 to 5 mm$^2$ The resulting films may have 0.5 to 50% open area, typically 0.5 to 5% open area when the film has very small apertures, which may not be visible to the naked eye, or 5 to 40% open area where the film has larger apertures.

6) Films or webs having corrugations, for instance having 1 to 6 folds per 10 mm with fold heights ranging from 0.05 to 3 mm The corrugations can be prepared by a ring roll lamination process. The films or webs may be apertured.

The scrubbing strip may be positioned such that, in use, it lies along one or both of the leading and trailing side edges of the head portion (ie. the "long" side edges), and/or the scrubbing strip may be positioned along one or both of the side edges of the head portion connecting the leading and trailing side edges (ie. the "narrow" side edges).

In one embodiment, the cleaning pad of the present invention may comprise two or more scrubbing strips, typically arranged to be on opposing side edges of the head portion of the cleaning implement, for instance the leading and trailing edges and in the direction of wiping, or on one of these side edges and an adjacent side edge. These scrubbing layers may comprise the same material, or different materials. It may, in certain instances, be advantageous for the two scrubbing layers to comprise different materials. For instance, one material may be chosen so as to loosen tough stains, and the other to pick up large particles loosened from the stain.

The scrubbing strip may also comprise additives to convey desirable properties, such as improved abrasion and resistance, increased stiffness, improved particle pick-up properties, or scent. Examples of suitable materials for improving abrasion include silicon carbide, aluminium oxide, calcium carbonate and talc. Examples of suitable additives for enhancing particle pick-up include waxes. Suitable waxes being disclosed in U.S. Patent No. 60/448,745, filed on 20 Feb. 2003.

The dimensions of the scrubbing strip can have a significant impact of the ability to remove tough stains and soils. Preferably the scrubbing strip extends substantially the entire length of a side edge of the head portion of the cleaning implement, when attached thereto. Typically, the scrubbing strip is rectangular in shape. For instance, the width (or y-dimension) of the scrubbing strip is typically in the range from 5 to 100 mm, preferably from 10 to 60 mm, and most preferably from 15 to 30 mm The length (or x-dimension) of the scrubbing strip is typically at least 20 mm, and preferably at least 50 mm, and more preferably is at least 100 mm, up to, for instance, 500 mm, and typically up to 300 mm Most preferably the scrubbing strip extends along the full length of the cleaning pad.

Also, increasing the z-dimension (thickness) of the scrubbing strip typically results in better tough stain removal. The improvement in tough stain removal by varying the dimensions of the scrubbing strip generally applies to scrubbing strips comprising a variety of materials. In addition, increasing the z-dimension (thickness) of the scrubbing strip, allows one to utilize softer materials, such as polypropylene without abrasive material, in the scrubbing strip while achieving a similar level of tough stain removal as compared to scrubbing strips comprising harder materials, such as nylon. Also, tough stain removal can be enhanced by incorporating a mixture of materials in the scrubbing strip, such as nylon and abrasive materials, such as silicon carbide, aluminum oxide, calcium carbonate, and the like, or a combination of a polyester wadding wrapped in a nylon netting.

The scrubbing strip may be of contrasting colour to the remainder of the cleaning pad, in order to facilitate its use, or to include branding information. Where a number of scrubbing strips are included on the cleaning pad it may be desirable that these are different colours, particularly where the scrubbing strips comprise different materials and serve different purposes, as described above.

The cleaning pad may comprise at least two distinct panels or sections having different degrees of absorbency. For instance, a preferred cleaning pad comprises a longitudinally-extending central panel (ie. extending in the x-dimension of the pad) comprising an absorbent layer, and a side panel abutting each longitudinally-extending side of the central panel, wherein at least one of the side panels comprises a scrubbing strip. On attachment to the head portion a cleaning implement, the central panel extends over the lower surface of the head portion and thus forms the major cleaning surface. The side panels extend along the side edges of the head portion of the cleaning implement. The side panels may also comprise absorbent material, optionally the same absorbent material as the central panel, but typically the side panels will be less absorbent to liquid than the central panel. The width of the central panel (ie. in the y-dimension) will depend upon the width of the head portion of the cleaning implement. However, typically, the central panel extends across at least one third of the width of the cleaning pad.

It is envisaged that a cleaning pad of this type, and indeed that the cleaning pads of the invention in general, may comprise a monolayer or multilayer structure, excluding from consideration the scrubbing strip. For instance, in a monolayer structure, panels of different absorbency may be provided by using different absorbent materials.

For clarity, in the context of the present invention, when reference is made to a portion of the cleaning pad extending over the lower surface of the head portion of a cleaning implement, this includes an embodiment in which the portion of the cleaning pad extends only partially over the lower surface of the head portion, and an embodiment in which the portion of the cleaning pad extends over substantially the entirety of the respective portion of the head portion, in either or both of the length and width dimensions. Typically, the central panel extends along the entire length of the cleaning pad but only over a portion of its width.

The cleaning pad may also comprise a scrubbing layer which, when attached to the cleaning implement, extends over the lower surface of the head portion of that cleaning implement. Typically, the scrubbing layer is outermost on the cleaning pad, and thus contacts the surface to be cleaned during the normal course of the cleaning operation. In this case, the scrubbing layer must necessarily be of lower abrasiveness than the scrubbing strip, in order not to damage the surface being cleaned.

The scrubbing layer may be a mono-layer or a multilayer structure. A wide range of materials are suitable for use in the scrubbing layer, for instance as disclosed in WO-A-0027271. In particular, the scrubbing layer may comprise woven and nonwoven materials; polymeric materials such as apertured formed thermoplastic films, apertured plastic films, and hydroformed thermoplastic films; porous foams; reticulated foams; reticulated thermoplastic films; and thermoplastic scrims. Suitable woven and nonwoven materials can comprise natural fibers (e.g., wood or cotton fibers), synthetic fibers such as polyolefins (e.g., polyethylene, particularly high density polyethylene, and polypropylene), polyesters (e.g., polyethylene terephthalate), polyimides (e.g., nylon) and synthetic cellulosics (e.g., RAYON®), polystyrene, and blends and copolymers thereof, and combinations of natural and synthetic fibers. Such synthetic fibers can be manufacture known processes such as carded, spunbond, meltblown, airlaid, needle punched and the like.

The cleaning pad also typically comprises attachment means for attaching the pad to a cleaning implement. Alternatively, the cleaning implement itself may include suitable attachment means. For instance, the cleaning pad may have an attachment layer that allows the pad to be connected to the implement's handle or head portion. The attachment layer can be necessary in those embodiments where the absorbent layer is not suitable for attaching the pad to the cleaning implement. The attachment layer can also function as a means to prevent fluid flow through the top surface (i.e., the handle-contacting surface) of the cleaning pad, and can further provide enhanced integrity of the pad. As with the scrubbing and absorbent layers, the attachment layer can consist of a monolayer or a multi-layer structure, so long as it meets the above requirements.

In a preferred embodiment of the present invention, the attachment layer will comprise a surface which is capable of being mechanically attached to the head portion of a cleaning implement by use of known hook and loop technology. In such an embodiment, the attachment layer will comprise at least one surface which is mechanically attachable to hooks that are permanently affixed to the bottom surface of the head portion.

In an alternative embodiment, the attachment layer can have a y-dimension (width) that is greater than the y-dimension of the other cleaning pad elements such that the attachment layer can then engage attachment structures located on a head portion of a handle of a cleaning implement.

The cleaning pad may be designed to have multiple cleaning surfaces or edges, each of which contact the soiled surface during the cleaning operation. In the context of a cleaning implement such as a mop, these surfaces or edges are provided such that during the typical cleaning operation (i.e., where the implement is moved back and forth in a direction substantially parallel to the pad's y-dimension or width), each of the surfaces or edges contact the surface being cleaned as a result of "rocking" of the cleaning pad. The effect of multiple edges is achieved by constructing the pad such that it has multiple widths through its dimension. That is, these multiple widths form a plurality of surfaces or edges along the front and rear of the pad. This aspect is discussed in more detail in WO-A-0027271.

The cleaning pad may also include one or more "free-floating" functional cuffs. Such cuffs improve the cleaning performance of the cleaning pad, by improving particulate pick-up. As a cleaning pad comprising functional cuff(s) is wiped back and forth across a hard surface, the functional cuff(s) "flip" from side to side, thus picking-up and trapping particulate matter. Cleaning pads having functional cuff(s) exhibit improved pick-up and entrapment of particulate matter, which are typically found on hard surfaces, and have a reduced tendency to redeposit such particulate matter on the surface being cleaned. Functional cuffs can comprise a variety of materials, including, but not limited to, carded polypropylene, rayon or polyester, hydroentangled polyester, spunbonded polypropylene, polyester, polyethylene, cotton, polypropylene, or blends thereof. Functional cuffs can be formed as an integral part of the cleaning pad, or can be separately adhered to the cleaning pad. If the functional cuffs are an integral part of the cleaning pad, the functional cuffs are preferably a looped functional cuff formed by crimping a lower portion of the cleaning pad, for example, in a Z-fold and/or C-fold. Alternatively, the functional cuffs can be separately adhered to the cleaning pad via a variety of methods known in the art including, but not limited to, double-sided adhesive tape, heat bonding, gluing, ultrasonic welding, stitching, high-pressure mechanical welding, and the like.

Preferably, the cleaning pad comprises two functional cuffs situated at or near opposite edges (e.g., the leading and trailing edges of the pad, in terms of the y-dimension) of the cleaning pad. Preferably, the functional cuff(s) are placed in a location such that their length is perpendicular to the back and forth mopping or wiping direction used by the consumer.

The size of the cleaning pad is determined by the cleaning implement to which it is to be attached. Typically, however, the cleaning pad will have dimensions in the range 100 to 300 mm×100 to 300 mm (expressed as (x-dimension)×(y-dimension)). Furthermore, the thickness of the cleaning pad (expressed as z-dimension) is typically in the range 1 mm to 20 mm, more preferably in the range 2 mm to 10 mm, although again this will depend upon the application to which the cleaning pad is to be put.

The various layers and/or elements of the present cleaning pad are preferably bonded together to form a unitary structure. The various layers and/or elements can be bonded in a variety of ways including, but not limited to, adhesive bonding, thermal and/or pressure bonding, ultra-sonic bonding, and the like. The various layers and/or elements can be assembled to form a cleaning pad either by hand or by a conventional line converting process known in the art.

When the layers and/or elements are adhesively bonded together, the adhesive is typically selected so that the bond formed by the adhesive is able to maintain its strength in wet environments, especially when the cleaning pad is saturated with fluid and/or soil. The selection of the adhesive is particularly important when bonding two absorbent layers together, bonding an absorbent layer and an attachment layer together, or bonding an absorbent layer and a liquid pervious scrubbing layer together. In this context, the adhesive is typically selected such that the adhesive provides a bond with high water resistence, e.g. with a bond retention of at least about 30%, preferably at least about 50%, and more preferably at least about 70% of the dry bond strength value. Bond strength values can be measured according to a partially modified ASTM D 1876-95 (1995) (I-Peel Test) standard method, which is described in detail in U.S. Pat. No. 5,969,025 issued Oct. 19, 1999 to Corzani.

Adhesives that can be used in the present invention include vinylic emulsions, including those based on vinyl acetate or other vinyl esters and ranging from homopolymers to copolymers with ethylene and/or acrylic monomers (vinyl acrylics); acrylic emulsions which can be either homopolymers or copolymers; a cross-linked adhesive including those created by including a reactive co-monomer (e.g., a monomer containing carboxyl, hydroxyl, epoxy, amide, isocyanate, or the like, functionality) which are capable of cross-linking the polymer themselves (e.g. carboxyl groups reacting with hydroxyl, epoxy or isocyanate groups) or by reaction with an external cross-linker (e.g. urea-formaldehyde resin, isocyanates, polyols, epoxides, amines and metal salts, especially zinc). The adhesives can also include limited quantities of tackifying resins to improve adhesion, such as the addition of hydrogenated rosin ester tackifier to a vinyl acetate/ethylene copolymer latex. Other suitable water-based adhesive compositions include those disclosed in U.S. Pat. No. 5,969,025 issued Oct. 19, 1999 to Corzani.

However, it may be difficult to bond some materials using adhesives, particularly where their structural integrity is not as strong as the adhesive bond ultimately formed. In this case, only those portions of the materials that are in direct contact with the adhesive will remain bonded to other materials, and the remainder of the material will readily separate from the material to which it was intended to be bonded. Materials of this type may be bonded using the method described in U.S. patent application Ser. No. 10/456,288, filed on Jun. 6, 2003 (McFall et al). The bonding technique described in this document allows bonding throughout the pad structure without the need for thermoplastic materials or adhesives.

Preferably, the pad is bonded or compressed, preferably throughout its thickness, at selected locations to form a plurality of discrete reservoirs or pockets within the pad structure, which are preferably in fluid communication with one another. This is particularly preferred in the context of pre-moistened cleaning pads. The reservoirs serve to reduce drippage when the cleaning pad is loaded with, for instance, a liquid cleaning composition.

Bonding may be achieved, for instance, by the application of heat and/or pressure, or ultrasonically. In one embodiment, the cleaning pad will comprise an absorbent core enclosed within an upper sheet and a lower sheet, and each fluid reservoir will contain a portion of the absorbent core. Bonds may take the form of line bonds extending substantially from one edge of the pad to another edge of the pad, and intersecting with other line bonds in order to create a plurality of adjacent reservoirs. Alternatively, a bonding pattern may be selected so as to create a plurality of reservoirs that are separated from one another rather than bordering one another. The reservoirs may be a variety of shapes, for instance selected from circles, ovals, diamonds, squares, rectangles, triangles, and hexagons, and combinations thereof.

The cleaning pad may be attached to a cleaning implement in dry form or it may have been pre-moistened (or impregnated) with a liquid cleaning composition. The cleaning composition is selected according to the surface to be cleaned.

The cleaning pad may be used with a variety of cleaning implements. One example of a suitable cleaning implement is in the form of a mop comprising a handle and a head portion (mop head) pivotally attached to the handle, for instance through a universal joint. The cleaning implement may also comprise a liquid delivery system, which may deliver liquid to the head portion or to the surface to be cleaned. For instance, the liquid delivery system may take the form of a spray mechanism that, in use, sprays a cleaning composition on to the surface to be cleaned in front of the head portion. The spray mechanism may be operated manually or may be operated by battery, motor or by other non-manual means.

The cleaning implement of the present invention may be used to clean a variety of hard surfaces. Preferably, however, they are used for cleaning floors. These floors mainly consist of ceramics, porcelain, marble, Formica®, no-wax vinyl, linoleum, wood, quarry tile, brick or cement, and the like.

After attachment of a cleaning pad to the cleaning implement, if the cleaning pad is of the dry-type (ie. not premoistened) it is necessary to apply a liquid cleaning composition to the head portion of the cleaning implement (and thereby the cleaning pad) and/or directly to the surface to be cleaned. The liquid cleaning composition may be applied to the cleaning pad simply by immersing the head portion of the cleaning implement into a bucket containing the liquid cleaning composition, which may have been diluted depending upon its constituents. In this case, the cleaning pad should preferably be wrung out prior to use, so that it is not dripping wet.

Alternatively, the liquid cleaning composition may be delivered directly to the head portion, for instance by means included on the cleaning implement, or directly by the consumer.

Another option is to apply the liquid cleaning composition directly to the surface to be cleaned, either in the form of a liquid or spray. This can be achieved via a separate squirt bottle or spray trigger system, or can be achieved by means directly attached or built-in to the cleaning implement, as described above.

If, however, a pre-moistened cleaning pad is to be used, there will typically be no need to apply additional liquid cleaning composition either to the cleaning pad or to the surface to be cleaned.

Cleaning is effected by wiping the head portion of the cleaning implement across the surface to be cleaned. A preferred wiping pattern consists of an up-and-down overlapping motion starting in the bottom left hand (or right hand) side of the section to be cleaned, and progressing the wiping pattern across the floor continuing to use up-and-down wiping motions. Wiping is then continued beginning at the top right (or left) side of the section to be cleaned and reversing the direction of the wipe pattern using a side-to-side motion. Another preferred wipe pattern consists of an up-and-down wiping motion, followed by an up-and-down wiping motion in the reverse direction. These thorough preferred wiping patterns allow the pad to loosen and absorb more solution, dirt and germs, and provide a better end result in doing so by minimizing residue left behind. Another benefit of the above wiping patterns is minimization of streaks as a result of improved spreading of solution and the elimination of streak lines from the edges of the pad.

When it is desired to remove a tough soil or stain from the surface, the head portion of the cleaning implement is tilted in order to bring the scrubbing strip on its side edge into contact with the tough soil. The tough soil is then removed by repeated, short, back and forth movements of the scrubbing strip across the soil.

Typically, after cleaning, the cleaning pad is removed and disposed of, and with it the germs and dirt removed from the surface, thereby promoting better hygiene and malodour control. However, the cleaning pad may be used for multiple cleaning, depending upon whether the pad is saturated with liquid and/or dirt. This can be readily ascertained by the consumer.

It may be desirable to rinse the surface after cleaning, and it may be desirable to use a fresh cleaning pad for this purpose, depending on the level of soiling of the original pad, or another product.

Typically, a plurality of cleaning pads are provided in a container or film wrapping for supply to the consumer, typically with instructions for attachment to a cleaning implement. Kits comprising a cleaning implement and cleaning pad are also provided, again typically with suitable operating instructions.

The present invention is now further described with reference to the accompanying drawings.

Figure 1:
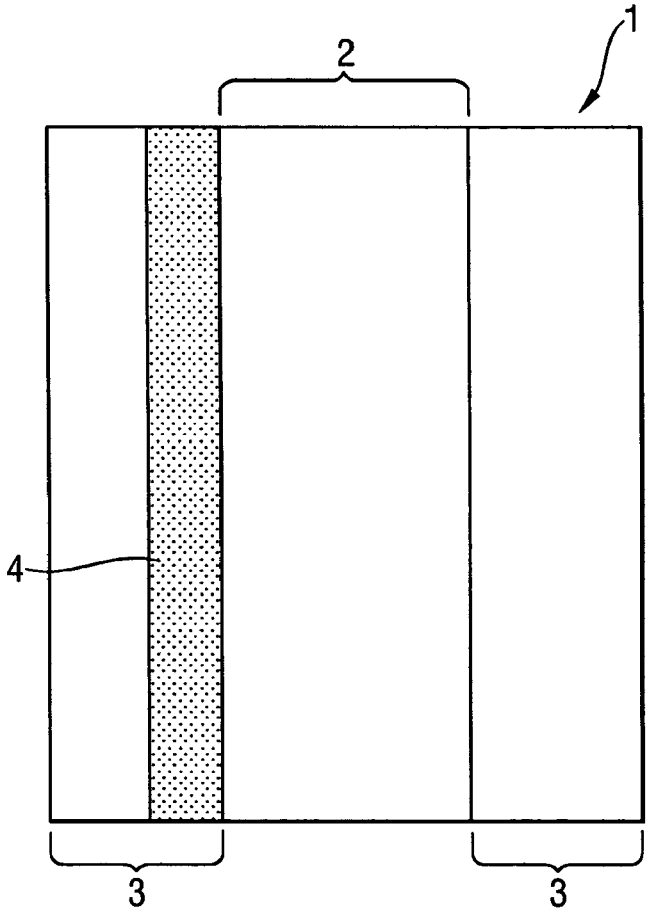
FIG. 1 is a plan view of the lower surface of a cleaning pad for use in the present invention.
Figure 4:
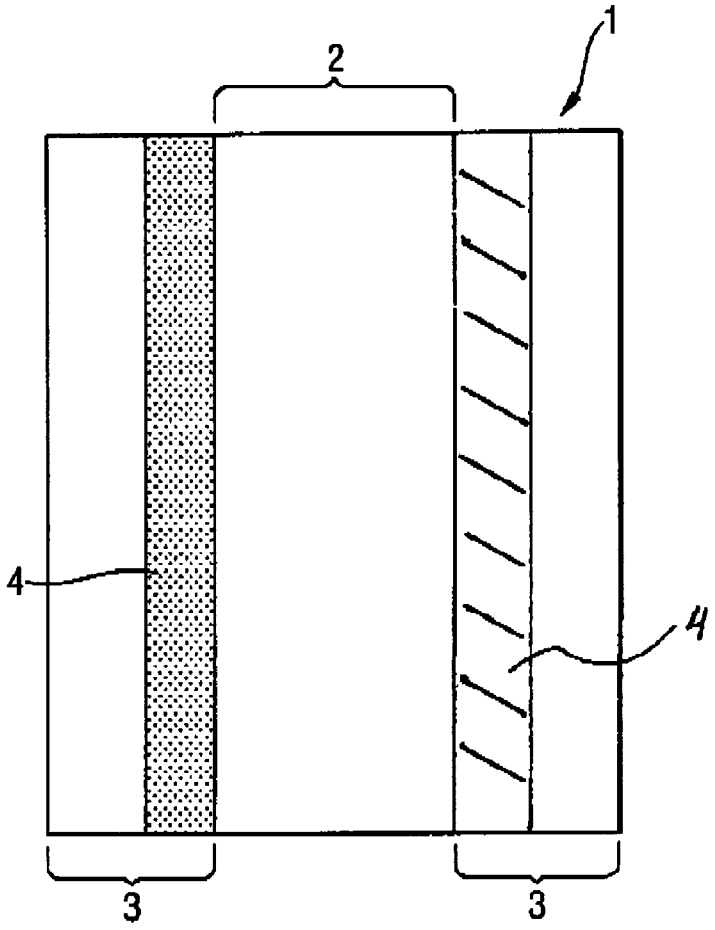
FIG. 4 is a plan view of an alternative embodiment of the lower surface of a cleaning pad for use in the present invention.

With reference to FIGS. 1 and 4, a cleaning pad 1 comprises a longitudinally-extending central panel 2 comprising multiple absorbent layers. Longitudinally-extending side panels 3 abut the central panel, and in this embodiment comprise absorbent material of lower absorbency than the central panel. One of more scrubbing strip 4 are located on one of the side panels and extends substantially the entire length of the side panel.

Figure 2:
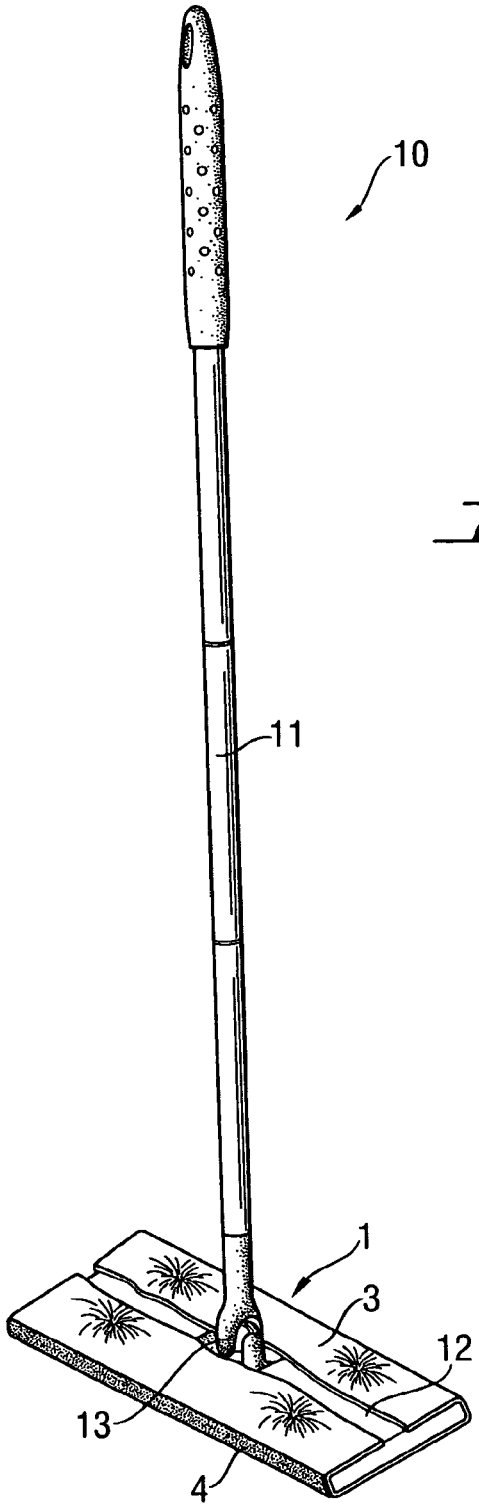
FIG. 2 is a perspective view of a cleaning implement according to the present invention.
Figure 3:
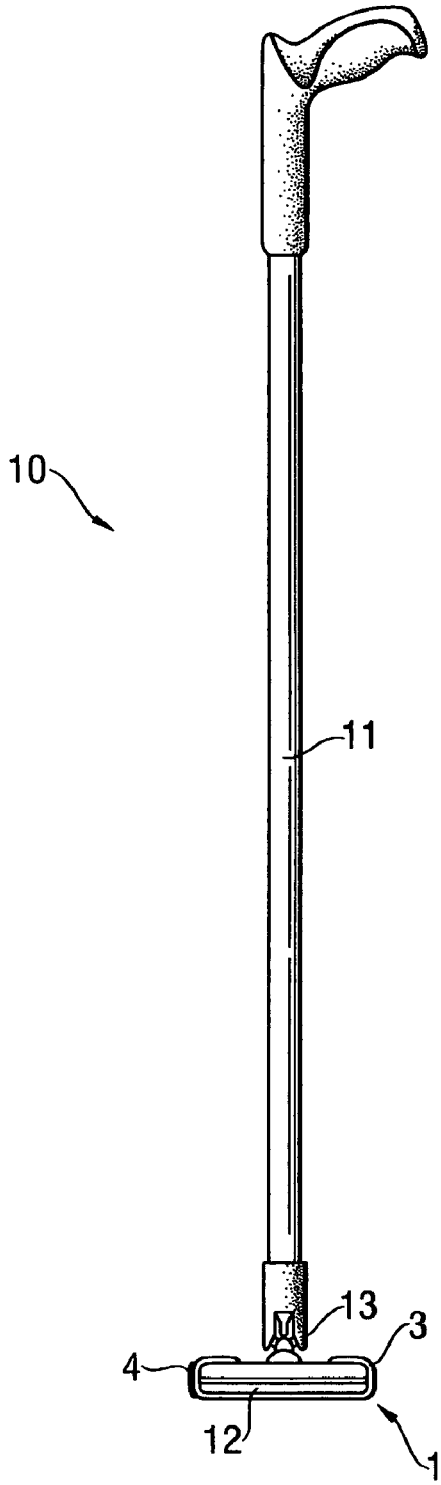
FIG. 3 is a side view of a cleaning implement according to the present invention.

With reference to FIGS. 2 and 3, a cleaning implement 10 made in accordance with one aspect of the present invention is illustrated, cleaning implement 10 comprises a handle 11, a head portion 12 attached to the handle by a universal joint 13. The cleaning implement 10 uses a removably attached cleaning pad substrate 1 for absorbing the cleaning liquid and particulates from the surface to be cleaned. The cleaning substrate 1 can be provided in one or more forms, such as a liquid absorbent pad or a liquid premoistened pad.

By virtue of its location on the cleaning pad, a scrubbing strip 4 extends along the leading edge of the mop. When scrubbing is required, a user of the mop simply turns the mop around 90°, and places the head portion 12 in an upright position so that the scrubbing strip contacts the floor.

All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning pad, said cleaning pad comprising:

an absorbent layer, and a thermoplastic film scrubbing strip joined to, and covering only a part of said absorbent layer, said scrubbing strip comprising a plurality of protrusions formed with and extending outwardly from said film.

2. A cleaning pad according to claim 1 wherein said scrubbing strip comprises a monolayer thermoplastic material.

3. A cleaning pad according to claim 2 wherein said protrusions of said scrubbing strip comprise domes, conical structures and/or frustroconical structures.

4. A cleaning pad according to claim 3 wherein said protrusions of said scrubbing strip are tapered.

5. A cleaning pad according to claim 4 wherein said scrubbing strip is liquid pervious.

6. A cleaning pad according to claim 5 wherein said scrubbing strip has 0.5 to 5% open area.

7. A cleaning pad according to claim 4 wherein said protrusions of said scrubbing strip are staggered relative to adjacent protrusions.

8. A cleaning pad according to claim 7 wherein said scrubbing strip further comprises apertures.

9. A cleaning pad according to claim 3 wherein said scrubbing strip further comprises particulate material.

10. A cleaning pad removably attachable to a cleaning implement, said cleaning pad comprising:

a longitudinally extending central panel, a side panel abutting said central panel, and said side panel comprising a thermoplastic film scrubbing strip joined thereto, said scrubbing strip comprising a plurality of protrusions formed integrally with and extending outwardly from said film and from said side panel.

11. A cleaning pad according to claim 10 wherein said scrubbing strip has a width of 5 to 60 mm, said width being less than the width of said side panel to which said scrubbing strip is joined.

12. A cleaning pad according to claim 11 having a length dimension and a width dimension orthogonal thereto, wherein said scrubbing extends along the full length of the cleaning pad.

13. A cleaning pad according to claim 12 wherein said central panel has two longitudinal edges and further comprising a second side panel, one said side panel abutting each longitudinal edge of said central panel.

14. A cleaning pad according to claim 13 wherein at least one of said central panel and said side panel comprises nonwoven material.

15. A rectangular cleaning pad according to claim 10 wherein said scrubbing strip is abrasive and is disposed on said cleaning pad in a position causing said scrubbing strip to be on a side edge of a head of a cleaning implement when said cleaning pad is removably attached thereto.

16. A cleaning pad removably attachable to a cleaning implement, said cleaning pad comprising:

an absorbent layer, an outwardly facing scrubbing layer joined thereto, and a thermoplastic film scrubbing strip joined to scrubbing layer and facing outwardly therefrom, said scrubbing strip comprising a plurality of protrusions formed integrally with and extending outwardly from said film.

17. A cleaning pad according to claim 16 wherein said absorbent layer comprises cellulosic material.

18. A cleaning pad according to claim 16 wherein said absorbent layer has first and second opposed faces, said scrubbing layer being joined to said first face and further comprising an attachment layer joined to said second face of said absorbent layer.

19. A cleaning pad according to claim 16 which is premoistened with a liquid cleaning composition.

20. A cleaning pad according to claim 19 wherein said scrubbing strip is discontinuous.

21. A cleaning pad according to claim 19 wherein said scrubbing strip has a color contrasting in color to the rest of the cleaning pad.

* * * * *